US008932101B2

(12) United States Patent
Silverglate et al.

(10) Patent No.: US 8,932,101 B2
(45) Date of Patent: Jan. 13, 2015

(54) ROLLER TOY APPARATUS

(75) Inventors: David E. Silverglate, Santa Cruz, CA (US); Brian Gulassa, Berkeley, CA (US)

(73) Assignee: Got I, LLC, Alpharetta, GA (US)

( * ) Notice: Subject to any disclaimer, the term of this patent is extended or adjusted under 35 U.S.C. 154(b) by 258 days.

(21) Appl. No.: 13/018,925

(22) Filed: Feb. 1, 2011

(65) Prior Publication Data

US 2011/0201249 A1 Aug. 18, 2011

Related U.S. Application Data

(60) Provisional application No. 61/304,487, filed on Feb. 15, 2010.

(51) Int. Cl.

| | |
|---|---|
| ***A63H 33/02*** | (2006.01) |
| ***A63H 5/00*** | (2006.01) |
| ***A63H 7/04*** | (2006.01) |

(52) U.S. Cl.

CPC ..... *A63H 33/02* (2013.01); *A63H 5/00* (2013.01); *A63H 7/04* (2013.01)

USPC ..... 446/450

(58) Field of Classification Search

USPC ..... 446/450, 453, 411–412; D21/405, 457, D21/763

See application file for complete search history.

(56) References Cited

U.S. PATENT DOCUMENTS

| | | | | |
|---|---|---|---|---|
| 693,064 | A * | 2/1902 | Fischer et al. | 601/129 |
| 1,077,340 | A * | 11/1913 | Graham | 446/266 |
| 4,128,909 | A | 12/1978 | Kawabe et al. | |
| 4,381,620 | A * | 5/1983 | Panzarella | 446/177 |
| 5,611,721 | A * | 3/1997 | Hoeting et al. | 446/419 |
| 6,729,984 | B2 | 5/2004 | Silverglate | |
| 2005/0045115 | A1 * | 3/2005 | Mann | 119/711 |
| 2006/0155225 | A1 | 7/2006 | Murdock et al. | |
| 2009/0170643 | A1 | 7/2009 | Silverglate | |

OTHER PUBLICATIONS

ISA Korea, International Search Report of PCT/US2011/023339, Oct. 27, 2011, WIPO, 3 pages.

* cited by examiner

*Primary Examiner* — Gene Kim
*Assistant Examiner* — Amir Klayman
(74) *Attorney, Agent, or Firm* — Alleman Hall McCoy Russell & Tuttle LLP

(57) ABSTRACT

A roller toy apparatus is provided. The roller toy apparatus may include a handle including a grasping portion, an elongate portion and a ball coupling portion, the ball coupling portion including a pair of left and right extensions, each of the left and right extensions including a respective mount extending inwardly into an interior region of the ball coupling portion. The roller toy apparatus may further include a ball rotatably coupled to the ball coupling portion. The ball may be formed of a mesh having a plurality of loop structures, each loop structure surrounding a void, and where each of a pair of loop structures is rotatably coupled to a respective mount of the ball coupling portion, to thereby rotatably couple the ball to the handle.

14 Claims, 4 Drawing Sheets

ROLLER TOY APPARATUS

CROSS REFERENCE TO RELATED APPLICATION

This application claims priority to U.S. Provisional Patent Application No. 61/304,487 filed Feb. 15, 2010, entitled Roller Toy Apparatus, which is hereby incorporated by reference in its entirety for all purposes.

BACKGROUND

Children and adults alike enjoy playing with balls and roller toys, such as push toys. One prior roller toy includes a handle coupled to a base with a hollow dome, which rolls on a pair of wheels that are coaxially mounted. One drawback with such a construction is that the wheels can sometimes be difficult to push for small children, particularly if rolled over uneven surfaces. Another drawback is that undesired noise and jarring can be experienced when the wheels roll along hard and/or bumpy surfaces.

SUMMARY

A roller toy apparatus is provided. The roller toy apparatus may include a handle having a grasping portion, an elongate portion and a ball coupling portion, the ball coupling portion including a pair of left and right extensions, each of the left and right extensions including a respective mount extending inwardly into an interior region of the ball coupling portion. The roller toy apparatus may further include a ball rotatably coupled to the ball coupling portion. The ball may be formed of a mesh having a plurality of loop structures, each loop structure surrounding a void, and each of a pair of loop structures may be rotatably coupled to a respective mount of the ball coupling portion, to thereby rotatably couple the ball to the handle. An object such as a rattle may be positioned within the ball.

A roller toy apparatus with the aforementioned configuration provides a number of benefits such as enabling a child to easily grasp and manipulate the roller toy apparatus. Furthermore the ball formed of the mesh enables the roller toy apparatus to be rolled on a variety of surface including bumpy and uneven surfaced. Further in some embodiments the ball may be resiliently deformable, and removable from the ball coupling portion. This enables the roller toy apparatus to be used in different types of play activities, with either the handle and ball coupled as a unit, or with the ball decoupled from the handle.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
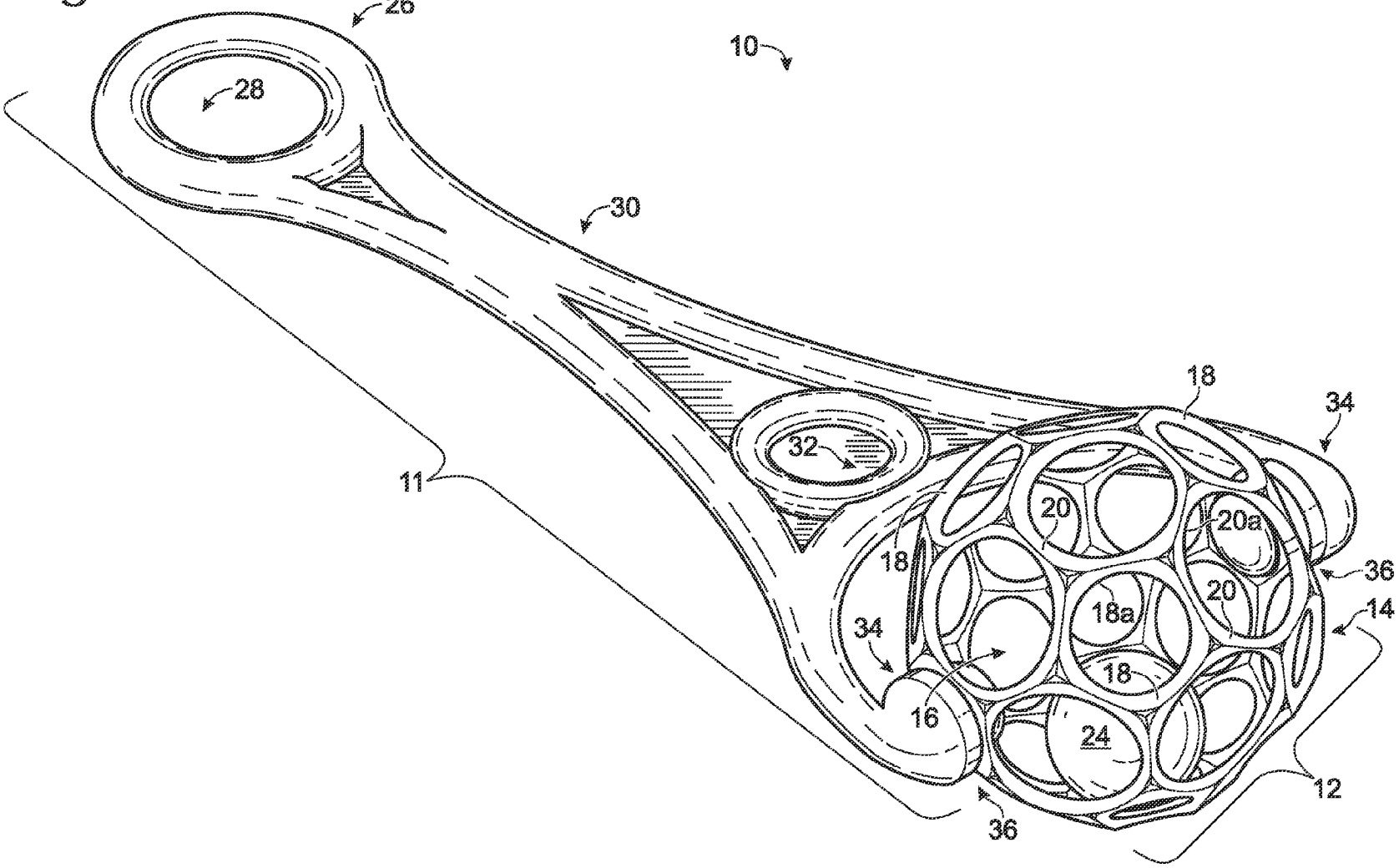
FIG. 1 is a perspective view of one embodiment of a roller toy apparatus according to the present invention.
Figure 2:
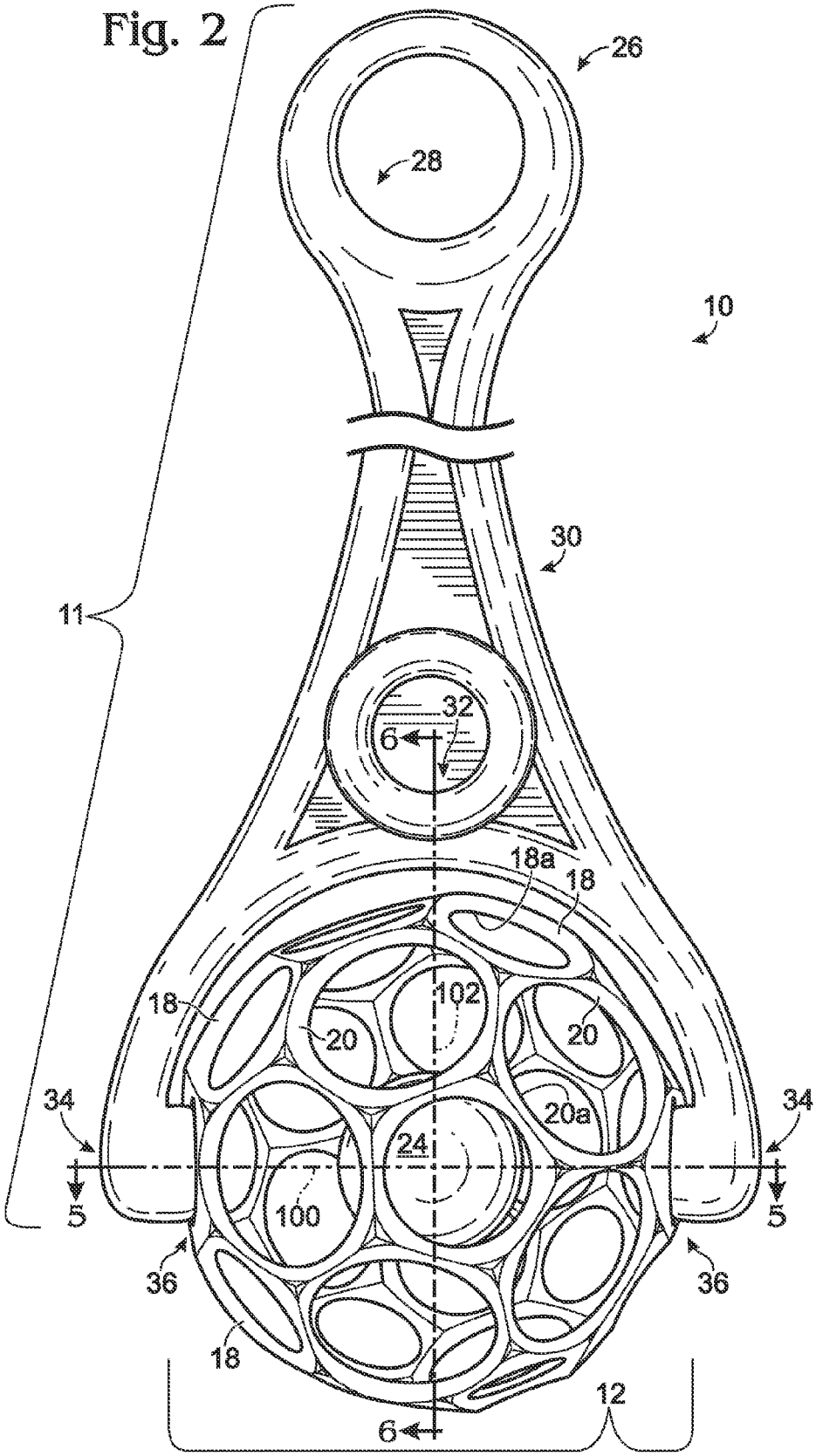
FIG. 2 is a top view of the roller toy apparatus of FIG. 1.

As illustrated in FIG. 1 and FIG. 2, a roller toy apparatus 10 is provided, which includes a handle 11 to which a ball 12 is rotatably coupled. A user, such as a child or adult, may push or pull the handle 11 to cause the ball 12 to roll along a floor, for example. The ball 12 may be a ball of the form described in U.S. Pat. No. 6,729,984, entitled TOY BALL APPARATUS, which issued May 4, 2004, the entire disclosure of which is hereby incorporated by reference.

For example, the ball 12 may be formed of a mesh 14 defining a void 16. Mesh 14 may be resiliently deformable. Mesh 14 may include a plurality of loop structures 18 and 20, which have cooperative mating surfaces 48, shown in FIG. 3 and described in greater detail herein, which are disposed at least partially around an outer perimeter of each loop structure 18 and 20. The plurality of loop structures 18 and 20 may have curved inside perimeter surfaces 18*a* and 20*a*, and the cooperative mating surfaces of adjacent loop structures may be configured to couple together for a distance along their lengths. The depicted loop structures 18 and 20 are differently sized. However, in other embodiments loop structures 18 and 20 may be equivalently sized. A ball of such a construction is easily grasped by the fingers of a child, and further may absorb impacts while rolling due to its resilience. Moreover, it will be appreciated that the use of loop structures may reduce the number of components for ball 12, thereby reducing manufacturing complexity and as a result manufacturing costs.

An object 24, such as a smaller second ball, may be positioned in an interior of ball 12. The object 24 may be sized so as to be insertable but not easily escapable from the void 16 defined by mesh 14 of ball 12, in some embodiments. In other embodiments, object 24 may be sized such that the resiliently deformable mesh may be deformed and the object may be removed from ball 12. As ball 12 rotates during use, object 24 is jostled about within an interior of the ball 12. In some embodiments, object 24 may be a rattle or other sound-making device, such that sound is generated as object 24 is jostled about during use. It will be appreciated that a multitude of other suitable objects may be positioned in the interior of the ball to provide visual and/or acoustic stimulation to a child. In the illustrated embodiment, object 24 is a transparent, hollow sphere with smaller colored balls contained therein. In other embodiments, object 24 may be provided with visually stimulating features, such as bright colors, a reflective coating, etc., to catch the eye as the object is jostled during use.

Handle 11 includes a first end with a grasping portion 26, which in this embodiment is formed in a ring shape with a void 28 formed therein. The ring-shaped grasping portion 26 is sized so that the hands of a child or other user may hold the grasping portion 26 in respective locations, with fingers extending into void 28, to provide a sufficient grip to push, pull, and rotate the device. In this way, a child may securely manipulate the device, decreasing the likelihood of loosing grip and dropping the device. It will be appreciated that the grasping portion 26 may be formed in other shapes, such as a T shape, Y shape, oval shape, rectangular shape, etc. The ring shape, oval shape, rectangular shape, or other closed shapes enable the roller toy apparatus to be placed on a hook, nail, etc., for storage. Typically, the handle 11 is substantially rigid, although portions of the handle may be flexible or resilient in some embodiments.

Handle 11 further includes an elongate portion 30 connecting the grasping portion 26 to a ball coupling portion 32. In the illustrated embodiment, ball coupling portion 32 is U-shaped, and includes respective left and right extensions 34, each of which is curved to accommodate a ball 12 positioned between the extensions, and each of which is provided with a mount 36 at a distal end configured to rotatably couple to ball 12. The mounts define the axis of rotation of roller toy apparatus 10. The mounts may include a number of structural features that enable ball 12 to rotatably couple to the mounts 36, discussed in greater detail herein with regard to FIGS. 4 and 5. Typically, the U-shaped ball coupling portion 32 is formed in the same plane as the ring-shaped grasping portion 26.

In some embodiments handle 11 may be hollow, decreasing the weight of the roller toy apparatus 10. However, in other examples, handle 11 may be formed out of a solid piece of material. Further in some embodiments, the handle may be formed from a variety of materials, such as plastic or polymer materials. Specifically in some embodiments, the handle may be formed of thermoplastic using an injection molding process.

Ball 12 may be formed from a variety of materials, such as various plastic or polymer materials. For example, loop structures 18 and 20 may be formed of thermoplastic using an injection molding process. In some embodiments the material used to construct handle 11 may have less elasticity than the material(s) used to construct ball 12. Further, in some embodiments the size, shape, and/or elasticity of the ball 12 and/or mounts 36 may enable the ball to be removed from handle 11, as discussed in greater detail below. Cutting plane 100, shown in FIG. 2, defines the cross-section shown in FIG. 5 and cutting plane 102, shown in FIG. 2, defines the cross-section shown in FIG. 6.

Figure 3:
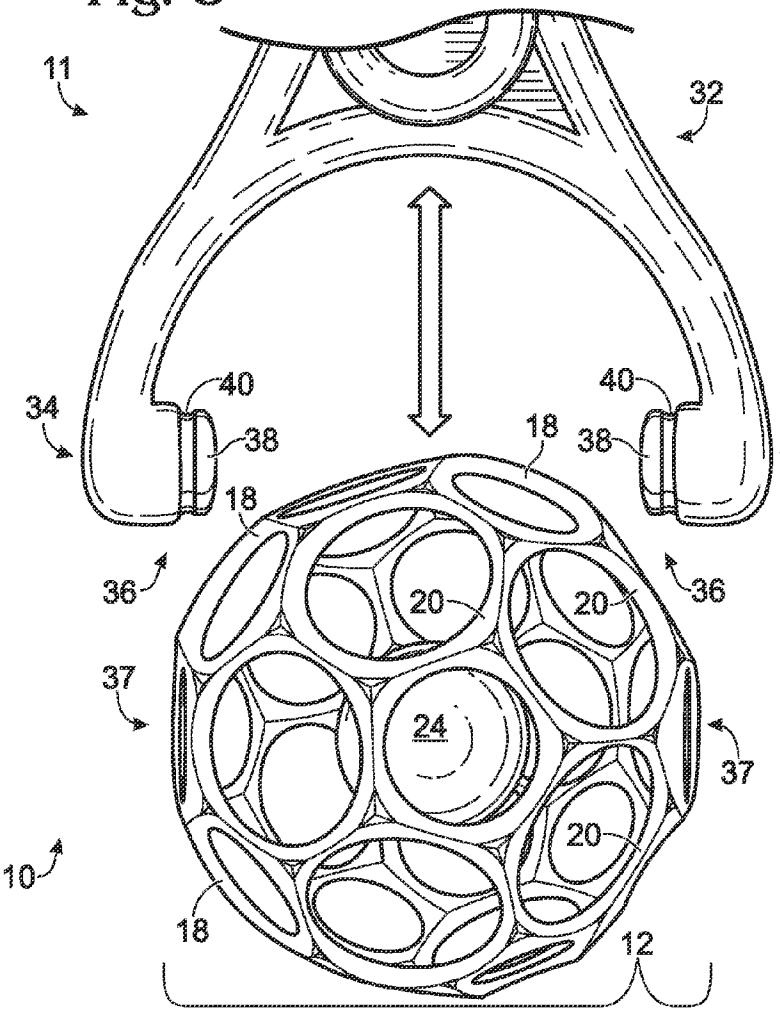
FIG. 3 is a partial top view of the roller toy apparatus of FIG. 1, showing a ball removed from a handle.

As shown in FIG. 3, ball 12 may be removed from handle 11 allowing the toy to be utilized in a multitude of play situations and as a result increasing the child's enjoyment of the toy. To install or remove ball 12 on handle 11, the ball is temporarily deformed and positioned between or removed from the mounts 36. Specifically, ball 12 is attached or released via deformation to engage or disengage the pair of loop structures 37 to or from mounts 36. In this way, ball 12 may be releasably coupled to ball coupling portion 32.

As described above, ball 12 is formed of a resiliently deformable mesh that includes a plurality of circular voids surrounded by loop structures having continuously curved (e.g., circular) inner perimeter surfaces. Respective opposed loop structures of the ball 12 are pushed over corresponding stay portions 38, and settle in grooves 40. Each opposed loop structure is seated in the corresponding groove 40, thereby rotatably coupling each of the opposed loop structures to the mount 36 of the corresponding groove 40. Thus, each groove and corresponding loop structure form a rotational interface, or joint, configured to enable rotation of the ball relative to the handle of the roller toy apparatus.

Figure 4:
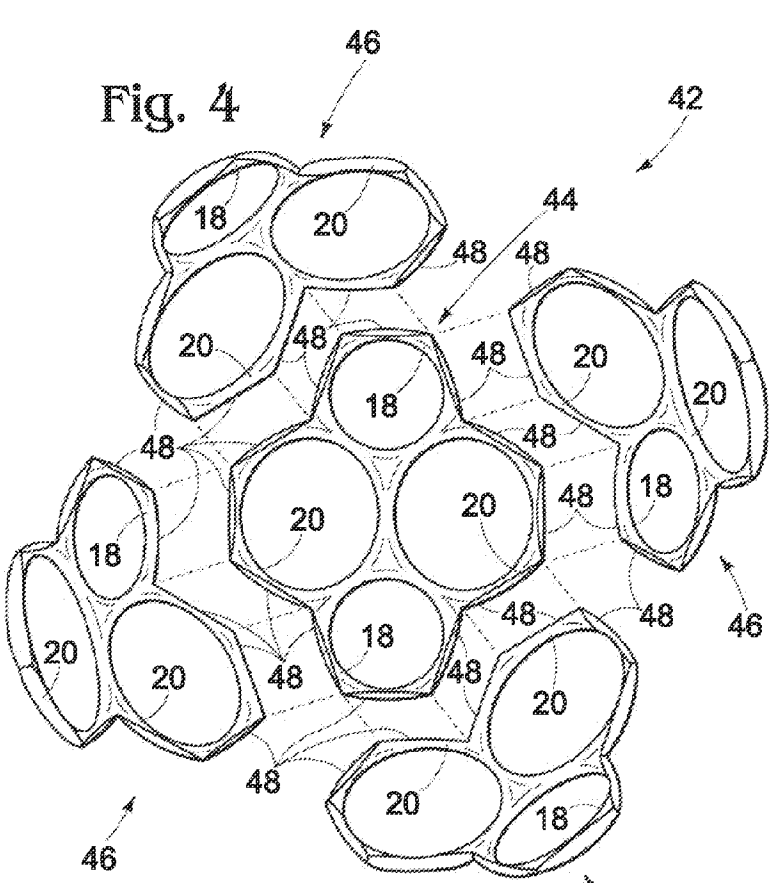
FIG. 4 is an exploded perspective view of the ball included in the roller toy apparatus of FIG. 1.

Referring to FIG. 4, an exploded view of an approximate hemisphere of ball 12, shown in FIGS. 1-3, is indicated generally at 42. Hemisphere 42 may include one four-loop structure assembly 44 and four two-loop structure assemblies 46, which may include cooperative mating surfaces 48. Mating surfaces 48 may be arranged around the perimeter of assemblies 44 and 46. Mating surfaces 48 also may be congruent and substantially planar. Alternatively, mating surfaces 48 may be complimentarily convex and concave in configuration, or any number of other complimentary surface configurations. In some examples, assemblies 44 may be constructed out of a material having a first color and assemblies 46 may be constructed out of a material having a second color, the first color different from the second color. In this way, the ball may provide additional visual stimulus.

A single four-loop assembly 44, and four three-loop assemblies 46 may be affixed together along mating surfaces 48, as indicated in FIG. 4, to form approximate hemisphere 42 of ball 12. Two hemispheres may then be affixed along mating surfaces 48 to form ball 12. In this regard, a fully formed ball 12 may include two assemblies four-loop 44 (which may be termed "ends") and eight three-loop assemblies 46 (which may be termed "sides").

Loop structures 18 may include mating surfaces 48 that are pentagonal in arrangement, while loop structures 20 may include mating surfaces 48 that are hexagonal in arrangement. It will be appreciated that many other configurations are possible. For example, loop structures 18 may include mating surfaces that are square in arrangement and loop structures 20 may include mating surfaces that are octagonal in arrangement, or any other compatible polygonal arrangements may be used. In such a configuration, the loop structures may still include continuously curved inner surfaces and that include no angular portions so as to be comfortable for gripping, catching and/or throwing, as well as better distributing forces and stress over the surface of ball 12.

Further, while the illustrated embodiments show ball 12 formed with loop structures 18, 20 over its entire surface, it will be appreciated that in some embodiments, the loop structures 18, 20 may be formed only over a portion of the ball 12. For example, in an alternative embodiment, only two loops structures may be provided on opposed sides of ball 12. In another embodiment, portions of the surface of ball 12 may be solid, and other portions may be formed of a mesh of loop structures. Still in other embodiments, accessories, such as a disk or rattle portion, may be inserted into one or more of the loop structures. Thus, it will be appreciated that numerous variations in the structure of ball 12 are possible.

Figure 5:
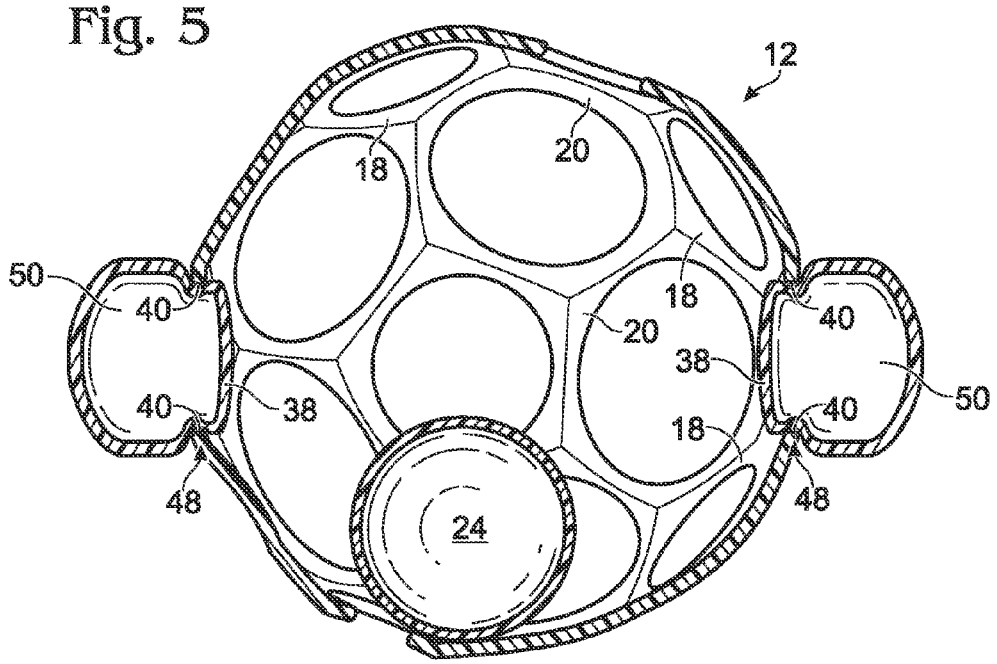
FIG. 5 is a cross-sectional view of the roller toy apparatus taken along line 5-5 in FIG. 1.
Figure 6:
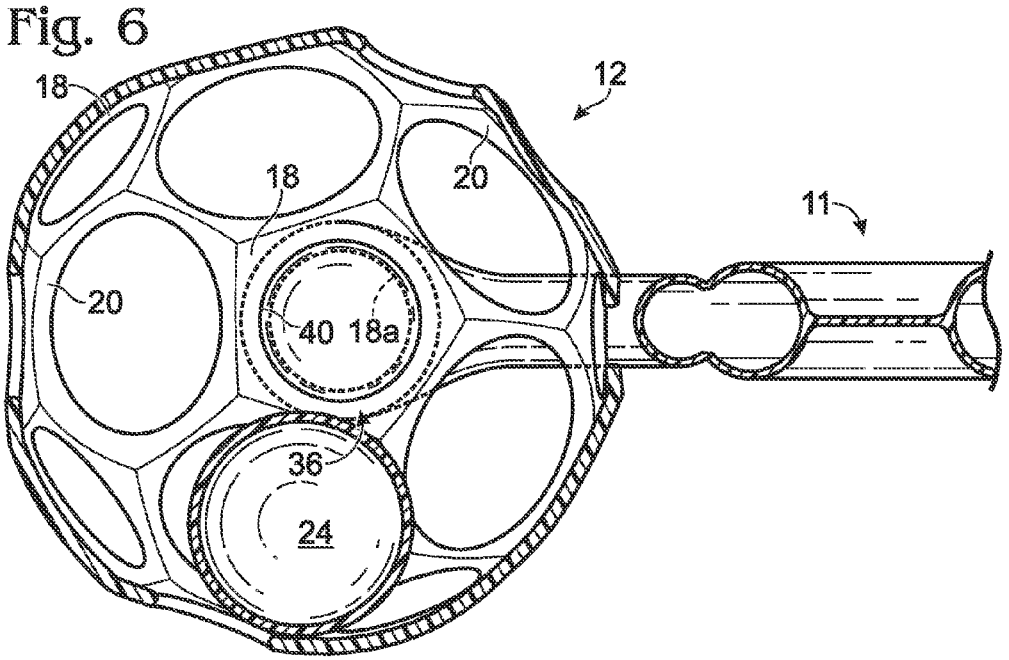
FIG. 6 is a cross-sectional view of the roller toy apparatus taken along line 6-6 in FIG. 1.

FIGS. 5 and 6 show cross-sectional views of roller toy apparatus 10. As shown in FIG. 5, each of mounts 36 is typically formed to include a projection 49 extending inwardly into an interior region of the U-shaped ball coupling portion 32. As shown projections 49 are spaced apart and do not intersect. In this way, the ball may be selectively attached to the handle, as previously discussed. Each projection includes groove 40 bounded on an outer side by a stopper portion 50 and on an inner side by a stay portion 38. Typically, the groove 40, stay portion 38, and stopper portion 50 are circular in cross section, and sized so that the diameter of the stopper portion 50 is larger than the diameter of the stay portion 52. Furthermore, mounts 36 are positioned within axially opposing loop structures, enabling smooth rotation of ball 12, as previously discussed. Further, it will be appreciated that the flexible nature of ball 12 may enable the loop structures to be deformed over the stay portions 38 to become properly seated.

FIG. 6 shows an end view of one of the mounts 36 included in handle 11. As shown, the stay portion 38 may have a diameter that is slightly larger than the loop structure 18, to inhibit unseating of the loop structures once they are positioned in the grooves 40, shown in FIG. 4. In other embodiments, the ball 12 may be mounted on mounts 36 that do not have an increased diameter on an inward side of the groove 40 (such as a cylindrical posts, or inwardly tapering posts), relying primarily on the shape of the ball to stay mounted.

The above described embodiments provide a roller toy apparatus with a resiliently deformable ball that is rotatably coupled to a handle. The roller toy apparatus may be easily rolled forward and backward over uneven surfaces, with any resultant jarring being absorbed by the ball. The roller toy apparatus provides superior maneuverability since it may be tilted to the side for easy turning by a user. Further the roller toy apparatus exhibits whimsical visual and sound effects due to an object being jostled within the ball during use. In addition, the ball and/or object may be removed from the handle for separate play.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A roller toy apparatus, comprising:

a substantially rigid handle including a grasping portion, an elongate portion and a ball coupling portion, the ball coupling portion including a pair of left and right extensions, each of the left and right extensions including a respective mount extending inwardly into an interior region of the ball coupling portion;, wherein each mount includes a groove within which a corresponding loop structure is seated and rotatably coupled, and a stopper portion on an outer side of the groove that has a larger diameter than the groove and a resiliently deformable ball rotatably coupled to the ball coupling portion, wherein the ball is formed of a mesh having a plurality of loop structures, each loop structure surrounding a void, and where a pair of loop structures in the plurality of loop structures is rotatably coupled to the mounts of the ball coupling portion, to thereby rotatably couple the ball to the handle, and wherein the ball freely rotates around only a single axis of rotation perpendicular to the handle, the single axis being defined by the mounts;

wherein a portion of each of the mounts extends into the void; wherein the ball is configured such that it can be attached or released from the handle via deformation to engage or disengage the pair of loop structures to or from the grooves in the mounts.

2. The roller toy apparatus of claim 1, wherein the plurality of loop structures of the ball have cooperative mating surfaces disposed at least partially around an outer perimeter of each loop structure, wherein the plurality of loop structures have curved inside perimeter surfaces, and wherein the cooperative mating surfaces of adjacent loop structures are configured to couple together for a distance along their lengths.

3. The roller toy apparatus of claim 1, further comprising an object positioned in an interior of the ball.

4. The roller toy apparatus of claim 3, wherein the object is a rattle.

5. The roller toy apparatus of claim 1, wherein the grasping portion is ring-shaped.

6. The roller toy apparatus of claim 1, wherein the ball coupling portion is U-shaped.

7. The roller toy apparatus of claim 1, wherein each mount further includes a stay portion on an inner side of the groove, each stay portion having a smaller diameter than the corresponding stopper portion, and each stay portion having a larger diameter than the corresponding loop structure, wherein the loops structures of the resiliently deformable ball are configured to deform to pass over the stay portion to engage or disengage the loop structures to or from the grooves.

8. The roller toy apparatus of claim 7, where the groove and the corresponding loop structure form a rotational interface configured to enable rotation of the roller toy apparatus.

9. The roller toy apparatus of claim 1, wherein the mounts are positioned within axially opposing loop structures.

10. The roller toy apparatus of claim 1, wherein a first portion of the loop structures are constructed out of a material having a first color and a second portion of the loop structures are constructed out of a material having a second color, the first color different from the second color.

11. The roller toy apparatus of claim 1, wherein a material of the ball has a greater elasticity than a material of the handle.

12. A roller toy apparatus, comprising:

a substantially rigid handle including a grasping portion, an elongate portion and a U-shaped ball coupling portion, the ball coupling portion including a pair of left and right extensions, each of the left and right extensions including a respective mount extending inwardly into an interior region of the ball coupling portion wherein each mount includes a groove within which a corresponding loop structure is seated and rotatably coupled, and a stopper portion on an outer side of the groove that has a larger diameter than the groove; and a resiliently deformable ball rotatably coupled to the ball coupling portion, wherein the ball is formed of a mesh having a plurality of loop structures, each loop structure surrounding a void, and where a pair of loop structures in the plurality of loop structures is rotatably coupled to the respective mounts of the ball coupling portion forming a rotational interface, to thereby rotatably couple the ball to the handle, the mounts being positioned within axially opposing loop structures, and wherein the ball freely rotates around only a single axis of rotation perpendicular to the handle, the single axis being defined by the mounts;

wherein a portion of each of the mounts extends into the void; and wherein the ball is configured such that it can be attached or released from the handle via deformation to engage or disengage the pair of loop structures to or from the groove in the mounts.

13. The roller toy apparatus of claim 12, wherein each mount further includes, a stay portion on an inner side of the groove, each stay portion having a smaller diameter than the corresponding stopper portion, and each stay portion having a larger diameter than the corresponding loop structure.

14. The roller toy apparatus of claim 12, wherein each loop structure has a continuously curved inside perimeter surface.

* * * * *